US008146526B2

(12) United States Patent
Gros

(10) Patent No.: US 8,146,526 B2
(45) Date of Patent: Apr. 3, 2012

(54) BOAT DOOR

(76) Inventor: Charles Preston Gros, White City, OR (US)

( * ) Notice: Subject to any disclaimer, the term of this patent is extended or adjusted under 35 U.S.C. 154(b) by 154 days.

(21) Appl. No.: 12/348,271

(22) Filed: Jan. 2, 2009

(65) Prior Publication Data

US 2010/0170430 A1 Jul. 8, 2010

(51) Int. Cl.
*B63B 17/00* (2006.01)

(52) U.S. Cl. ..... 114/201 R; 114/362

(58) Field of Classification Search ..... 114/362, 114/201 R

See application file for complete search history.

(56) References Cited

U.S. PATENT DOCUMENTS

| | | | | |
|---|---|---|---|---|
| 2,421,400 | A | 6/1947 | Young | |
| 3,563,069 | A * | 2/1971 | Ferrer | 70/129 |
| 3,913,971 | A * | 10/1975 | Green | 296/218 |
| 4,385,580 | A | 5/1983 | Davidson | |
| 4,479,753 | A * | 10/1984 | Thorley | 414/541 |
| 4,833,829 | A * | 5/1989 | Wilson | 49/426 |
| 4,926,781 | A * | 5/1990 | Bauer | 114/351 |
| 7,004,101 | B1 * | 2/2006 | Mardikian | 114/362 |
| 7,011,036 | B1 * | 3/2006 | Hill | 114/362 |
| 2007/0295257 | A1 | 12/2007 | Martin | |

* cited by examiner

*Primary Examiner* — Stephen Avila
(74) *Attorney, Agent, or Firm* — Robert J. Sayfie

(57) ABSTRACT

A boat hull having a door that can swing to an open position and closed position. The door can be used for entering or exiting the boat. The door can remain closed by a latch, or a door handle. A seal may be disposed between the door and the door frame to keep water out. A ramp may be used when the door is open to allow for easier entry for people using wheeled luggage, wheelchairs, or walkers.

3 Claims, 5 Drawing Sheets

BOAT DOOR

GOVERNMENT RIGHTS

This invention was not made with Government support under. The Government does not have any rights in this invention.

BACKGROUND OF THE INVENTION

This invention relates to a boat door. This invention relates to doors for drift or dory boats.

U.S. Patent Application Publication number 2007/0295257 discloses a boat having an outside pocket door, which slides in the housing for entry and egress.

U.S. Pat. No. 4,833,829 discloses a sliding door for closure of entranceways and to companionway entrance closure for watercraft.

There is a need for an entry and egress door on fishing boats. There is need for an entry and egress door on drift or dory boats.

The present invention door or doors make it easier for a passenger to enter or exit the boat. Without a door the passenger would have to lift their leg over the gunwale or side of the boat causing a potentially dangerous falling situation by putting passenger off balance if they catch their shoe or boot or foot. Older people, children, or people with disabilities particularly have problems climbing in and out of boats. Having a door cuts the distance to climb into the boat by close to half making it similar to getting into a vehicle with a door.

The door also makes it easier to get into the boat while boat is on a trailer. Present designs force the person wanting to get in the boat to climb over the gunwale or side of the boat creating a potentially dangerous situation. The door makes this simpler by dropping the distance it takes to maneuver the side or gunwale of the boat.

The main usage of a drift or a dory boat is for different types of fishing. Passengers may be wearing hip waders for fly fishing, or boots to keep warm and dry in winter seasons. Having to maneuver in and out of the boat while wearing this type of gear is made easier with a door.

In addition, the door of the present invention is adaptable for receiving a ramp, so that people using crutches, walkers, or wheelchairs may be capable of entering and exiting the boat safely.

The door or doors of the present invention are located above the water line to allow the door to be opened while traveling if the water conditions are favorable.

SUMMARY OF THE INVENTION

One aspect of the present invention is a boat hull (10), comprising: a first member (95) extending downwardly from a hull top (105) to a ledge (90), said edge (90) extending from said first member (95) forwardly to a second member (100), said second member (100) extending from said ledge (90) upwardly to said hull top (105); a hinge (20) disposed on said first member (95), said hinge (20) aligned substantially vertically; and a door (15) connected to said hinge (20) so said door (15) can swing from an open position (110) to a closed position (115).

Another aspect is a boat hull (10), comprising: a hull top (105); a door frame defined by a ledge (90) disposed downwardly from said hull top (105), a first member (95) extending from said hull top (105) downwardly to said ledge (90); a second member (100) extending from said hull top (105) downwardly to said ledge (90); and a door (15) hingedly connected to the door frame.

REFERENCE NUMERALS

10 boat hull
14 telescoping door
15 door
17 door inside surface
19 door outside surface
20 hinge
30 outside latch
40 seal
50 ramp
55 lip
60 inside latch
70 rear edge
75 lower edge
80 front edge
90 ledge
95 first member
100 second member
105 hull top
110 open position
115 closed position
120 hull inside
125 latch receiver

DETAILED DESCRIPTION OF THE INVENTION

The following detailed description is of the best currently contemplated modes of carrying out the invention. The description is not to be taken in a limiting sense, but is made merely for illustrating the general principles of the invention, since the scope of the invention is best defined by the appended claims.

Broadly, the present invention is a door 15 for boats. More particularly, it is a door 15 for drift or dory boats.

Figure 1:
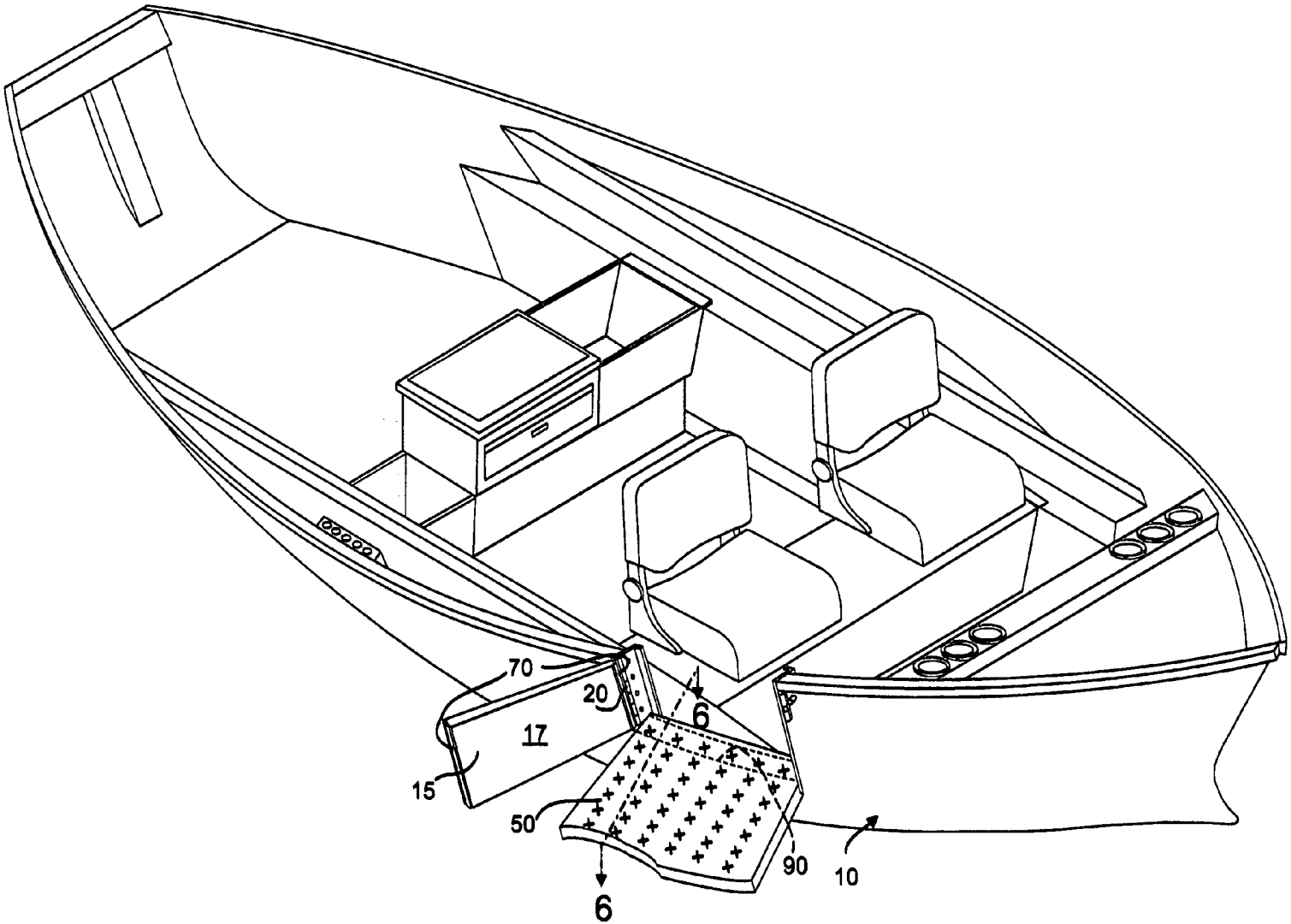
FIG. 1 is a pictorial of an embodiment of the present invention.

FIG. 1 is a pictorial of an embodiment of the present invention 15. The door 15 may be hingedly connected to the boat hull 10 via a hinge 20. In one embodiment, the door 15 may be hingedly connected to the boat hull 10 via a hinge 20 on a rear edge 70 of the door 15. In this embodiment the door 15 would open similar to suicide doors of an automobile.

Figure 5:
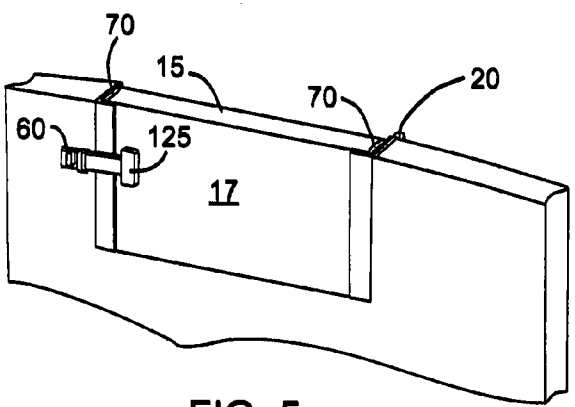
FIG. 5 is a pictorial of an embodiment of an inside of a door showing the inside latch.

In one embodiment, the door 15 may remain closed by an inside latch 60, as illustrated in FIG. 5.

Figure 2:
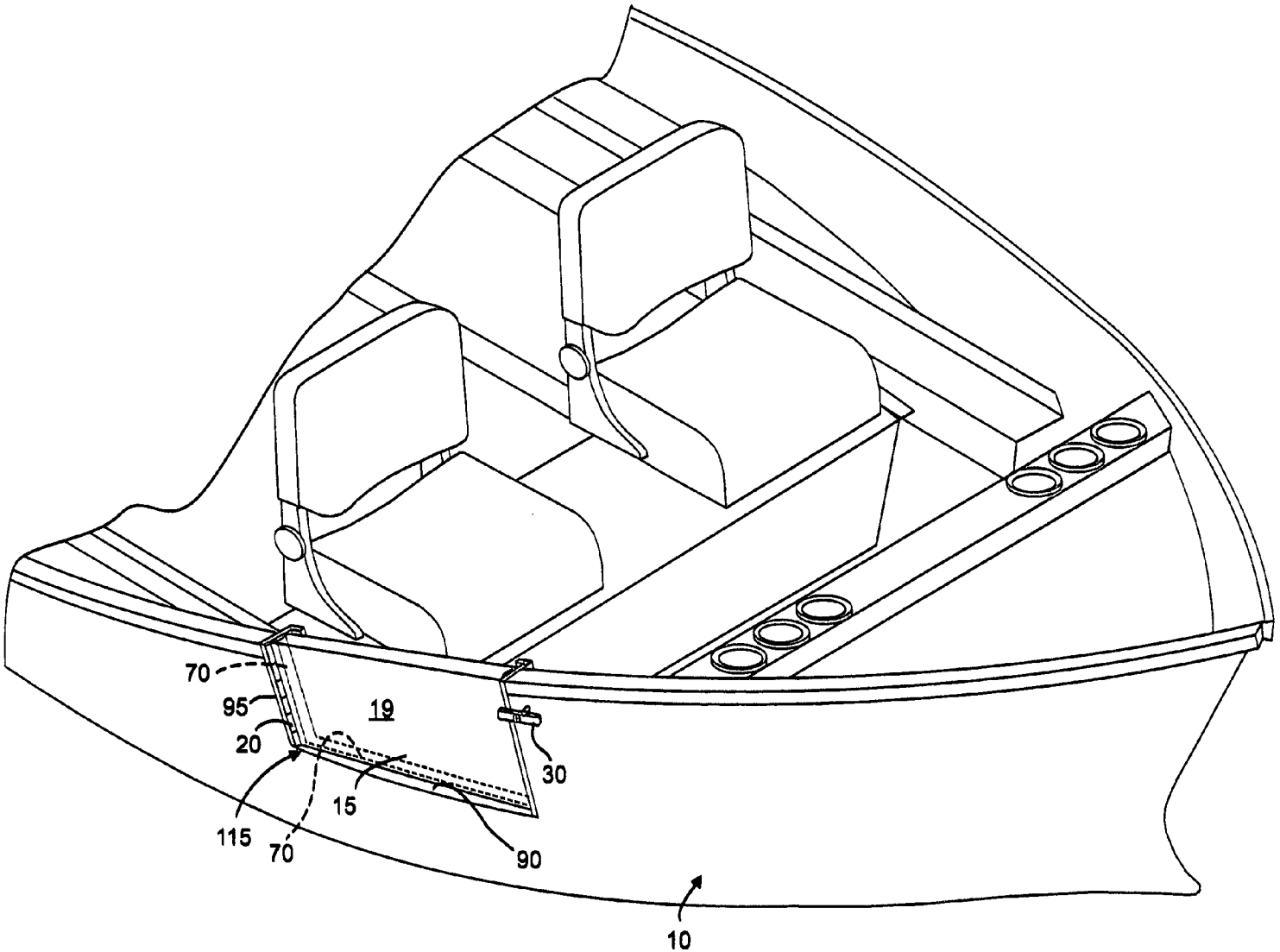
FIG. 2 is a pictorial of an embodiment of the present invention, showing closer view of the door compared with FIG. 1.

In another embodiment, the door 15 may remain closed by an outside latch 30, as illustrated in FIG. 2. The door 15 may remain closed by the use of either the inside latch 60 or the outside latch 30 that may be disposed near the front edge 80 of the door 15.

The latch 60 may be disposed on the hull inside 120, and the latch receiver 125 may be disposed on the door inside surface 17. Conversely the latch 60 may be disposed on the door inside surface 17, and the latch receiver 125 may be disposed on the hull inside (120). The latch 60 is engageable with said latch receiver 125.

Figure 6:
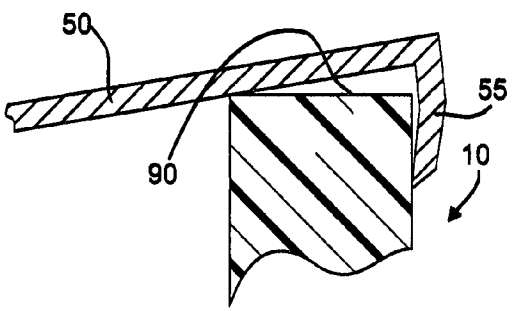
FIG. 6 is a sectional view of line 6 from FIG. 1.

FIG. 1 also illustrates that a ramp 50 may be secured on the ledge 90. In one embodiment the ramp 50 may have a lip 55, which may assist in securing the ramp 50 to the boat hull 10, as illustrated in FIG. 6. FIG. 6 illustrates the lip 55 that extends downwardly from the ramp 50, and prevents the ramp 50 from slipping off the ledge 90. In one embodiment the ramp 50 may be 36 inches wide. In another embodiment, the ramp 50 may be 48 inches wide.

Figure 3:
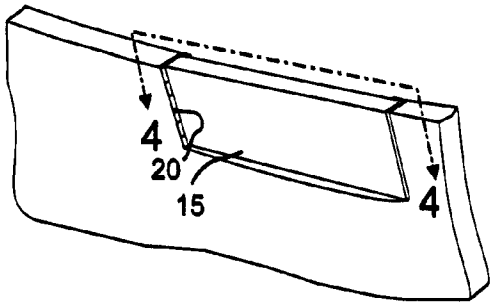
FIG. 3 is a pictorial of an embodiment of a door of the present invention.

FIG. 3 illustrates on embodiment of the door 15 having a seal 40 that may be disposed anywhere on the door 15 between the door 15 and the boat hull 15 to prevent water from entering between the door 15 and the boat hull 10. The seal may be a rubberized material like that used for refrigerator doors.

FIG. 3 illustrates one embodiment of the door 15 where the door 15 has a seal 40 disposed on the front edge 80 of the door, and on the lower edge 75.

Figure 4:
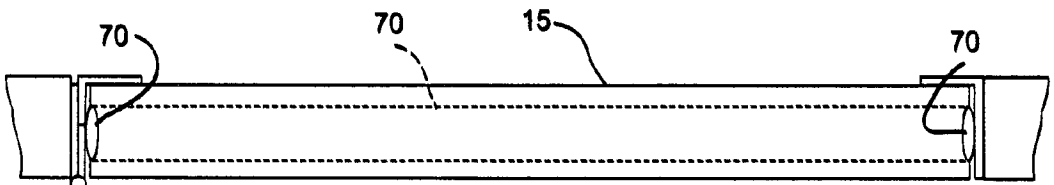
FIG. 4 is a sectional view of line 4 from FIG. 3.

FIG. 4 illustrates a sectional view of the door 15 and the seal 40 disposed along the front edge 80. FIG. 4 also illustrates the hinge 20 disposed along the rear edge 70.

In another embodiment, the hinge 20 may be disposed along the front edge 80.

In another embodiment a seal 40 may be disposed along the rear edge 70 when the hinge 20 is disposed along the front edge 80.

Figure 7:
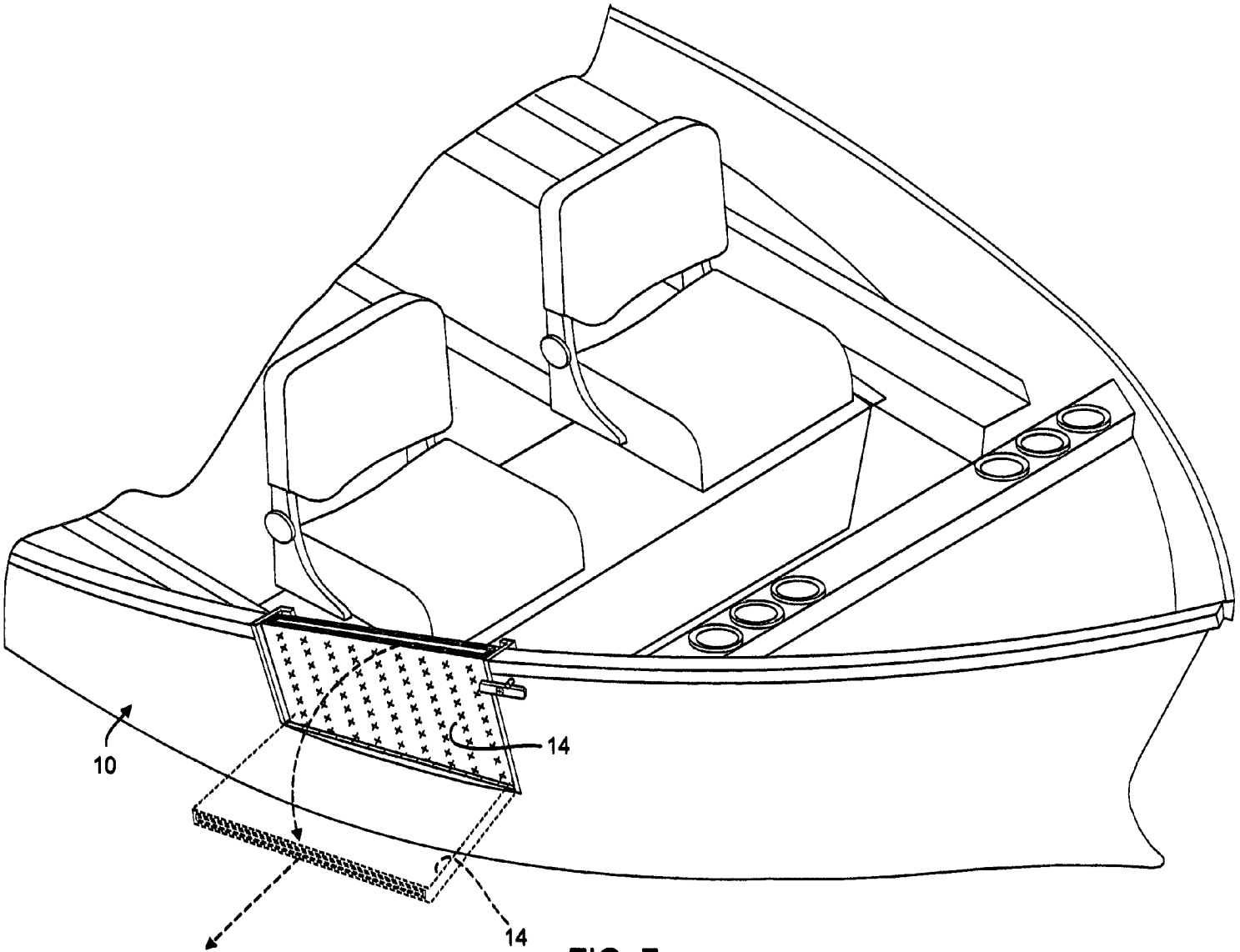
FIG. 7 is a pictorial view of another embodiment of the invention.

In another embodiment, as illustrated in FIG. 7, the hinge may be dispose along the lower edge 75, and seals 40 may be placed along the rear edge 70 and the front edge 80. In this embodiment the door 15 would open downwardly.

Although the seals 40 have been disclosed as being on the door 15, the seal 40 could be placed on at least one of the first member 95, the ledge 90, or the second member 100.

The door 15 may swing open via a hinge 20 outwardly, as illustrated. In another embodiment the door 15 may open inwardly.

Figure 8:
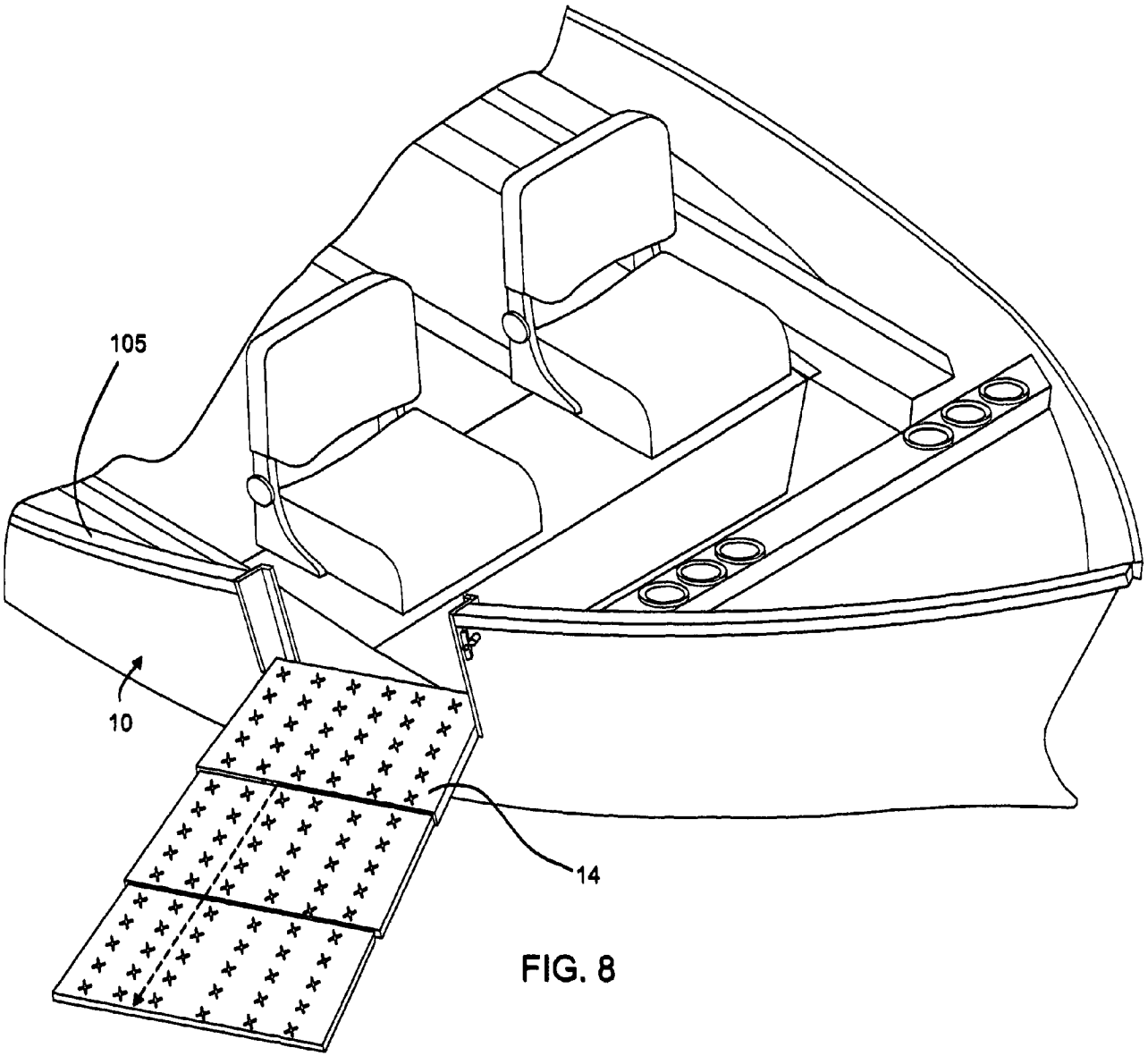
FIG. 8 is a pictorial view of the telescoping door that can flip downwardly.

FIG. 8 illustrates a telescoping door 14 that may be hingedly connected so that the telescoping door 14 folds downwardly. This telescoping door would eliminate the need of a separate ramp 50. In this embodiment the telescoping door 14 would telescope inwardly and could be flipped up as shown in FIG. 7. When the telescoping door 14 or door 15 is flipped upwardly, it may be flush with the hull top 105. When the telescoping door 14 or door 15 is connected via a hinge 20, the hinge 20 may connect to both the lower edge 75 and the ledge 90.

In another embodiment, the door 15 may slide in and out by the use of channels and guides.

It should be understood, of course, that the foregoing relates to exemplary embodiments of the invention and that modifications may be made without departing from the spirit and scope of the invention as set forth in the following claims.

I claim:

1. A boat hull (10), comprising:

a first member (95) extending downwardly from a hull top (105) to a ledge (90), said ledge (90) extending from said first member (95) forwardly to a second member (100), said second member (100) extending from said ledge (90) upwardly to said hull top (105);

a hinge (20) disposed on said first member (95), said hinge (20) aligned substantially vertically;

a door (15) connected to said hinge (20) so said door (15) can swing from an open position (110) to a closed position (115); and a ramp (50) removably engaged with said ledge (90), said ledge (90) disposed downwardly from a hull top (105).

2. A boat hull (10), comprising:

a first member (95) extending downwardly from a hull top (105) to a ledge (90), said ledge (90) extending from said first member (95) forwardly to a second member (100), said second member (100) extending from said ledge (90) upwardly to said hull top (105);

a hinge (20) disposed on said first member (95), said hinge (20) aligned substantially vertically;

a door (15) connected to said hinge (20) so said door (15) can swing from an open position (110) to a closed position (115); and a ramp (50) has a lip (55) extending downwardly from said ramp (50) to prevent the ramp (50) from slipping off said ledge (90), said ledge (90) disposed downwardly from a hull top (105).

3. A boat hull (10), comprising:

a hull to (105);

a door frame defined by a ledge (90) disposed downwardly from said hull top (105), a first member (95) extending from said hull top (105) downwardly to said ledge (90);

a second member (100) extending from said hull top (105) downwardly to said ledge (90); and a door (15) hingedly connected to the door frame; and a ramp (50) removably disposed on said ledge (90), said ramp (50) having a lip (55) extending downwardly from said ramp (50) so that said ramp (50) does not slip off of said ledge (90).

* * * * *